US005435907A

United States Patent [19]

Sudhakar et al.

[11] Patent Number: 5,435,907

[45] Date of Patent: Jul. 25, 1995

[54] HYDRODEAROMATIZATION OF MIDDLE DISTILLATE HYDROCARBONS

[75] Inventors: Chakka Sudhakar, Wappingers Falls; Frank Dolfinger, Jr., Poughkeepsie; Dennis J. Pao, Hopewell Junction; John Hazen, Cragsmoor, all of N.Y.

[73] Assignee: Texaco Inc., White Plains, N.Y.

[21] Appl. No.: 189,992

[22] Filed: Jan. 31, 1994

Related U.S. Application Data

[63] Continuation of Ser. No. 871,145, Apr. 20, 1992, abandoned.

[51] Int. Cl.[6] ..... C10G 45/04; C10G 45/46

[52] U.S. Cl. ..... 208/143; 208/144; 208/216 R; 208/216 PP; 208/217; 208/254 H; 585/260; 585/266; 585/269; 585/270; 585/275

[58] Field of Search ..... 208/143, 144, 216 R, 208/216 PP, 217, 254 H; 585/260, 266, 269, 270, 275; 502/182, 185

[56] References Cited

U.S. PATENT DOCUMENTS

| | | | |
|---|---|---|---|
| 1,965,956 | 7/1934 | Dunkel et al. | 585/270 |
| 3,812,028 | 5/1974 | Wennerberg et al. | 208/112 |
| 4,313,852 | 2/1982 | Gavin et al. | 502/180 |
| 4,518,488 | 5/1985 | Wennerberg | 208/144 |
| 4,532,227 | 7/1985 | Suggitt | 585/269 |

*Primary Examiner*—Anthony McFarlane
*Assistant Examiner*—Walter D. Griffin
*Attorney, Agent, or Firm*—Kenneth R. Priem; Cynthia L. Hunter; Richard A. Morgan

[57] ABSTRACT

A naphtha or a middle distillate hydrocarbon is dehydroaromatized by hydrotreating in the presence of a catalyst containing non-noble Group VIII metal and Group VI-B metal on carbon.

10 Claims, No Drawings

HYDRODEAROMATIZATION OF MIDDLE DISTILLATE HYDROCARBONS

This application is a continuation of application Ser. No. 871,145, filed on Apr. 20, 1992, now abandoned.

FIELD OF THE INVENTION

This invention relates to a process for hydrodearomatizing middle distillate hydrocarbons. More particularly it relates to a process for treating a hydrocarbon diesel oil to convert aromatic hydrocarbon components to non-aromatic hydrocarbon components.

BACKGROUND OF THE INVENTION

As is well known to those skilled in the art, aromatic hydrocarbons in middle distillate fuels such as gasoline or diesel oil represent a source of atmospheric pollution. The aromatic content of those middle distillates may be as high as 85 v %. An illustrative light straight run gas oil may for example be typically found to contain 30 v % aromatics. As environmental considerations become of greater concern, it is desirable to treat middle distillate hydrocarbons to decrease the content of undesirable aromatic components.

USP 3,997,473 (and its divisional USP 4,032,435) is directed to hydrodesulfurization of petroleum residues by use of a nickel/molybdenum on carbon catalyst which is characterized by an average pore radius of at least 25 Å and a BET Surface area of 200–800 $m^2/g$. The catalyst of these patents has a loading of VI-B metal "of at least 10 and up to about 20 weight percent expressed as metal oxide based on the weight of the catalyst support."

USP 4,082,652 is directed to treatment of heavy oils, such as gas oils, to effect hydrodesulfurization by use of a molybdenum/nickel on carbon catalyst. The catalyst preparation requires that the molybdenum be deposited first then sulfided, and only then that the nickel be added.

USP 3,546, 103 is directed to the removal of metals and coke from hydrocarbon resids by use of, as precatalyst, metals of Group II-B or VI-B plus VIII on charcoal.

USP 3,367,862 is directed to desulfurization of heavy residual hydrocarbons by hydrolysis with water in the presence of catalyst on a char base.

USP 4,313,852 is directed to hydrotreating of heavy petroleum feedstocks in the presence of a sulfided molybdenum or tungsten on active carbon, with or without a second metalic component.

USP 3,725,303 is directed to treating of aqueous solutions of oxy-sulfur compounds (such as sodium thiosulfate) by use of a catalyst containing molybdenum sulfide and cobalt sulfide.

It is an object of this invention to provide a novel process for hydrodearomatizing middle distillate hydrocarbons. Other objects will be apparent to those skilled in the art.

STATEMENT OF THE INVENTION

In accordance with certain of its aspects, this invention is directed to a process for treating a charge naphtha or middle distillate hydrocarbon containing undesired aromatic components which comprises maintaining a bed of sulfided catalyst containing a metal of non-noble Group VIII and of VIB on a carbon support;

passing a charge hydrocarbon in the presence of hydrogen into contact with said sulfided catalyst containing a metal of non-noble Group VIII and of VIB on a carbon support at hydrotreating conditions thereby effecting hydrodearomatization of said charge hydrocarbon containing undesired aromatic components and forming a product stream of hydrocarbon containing a lesser quantity of undesired aromatic components; and recovering said product stream of hydrocarbon containing a lesser quantity of undesired aromatic components.

DESCRIPTION OF THE INVENTION

The charge hydrocarbons which may be treated by the process of this invention may be those which are commonly designated as naphtha or middle distillates. Typically naphtha may have an ibp of at least about 70° F. and typically 80° F.–120° F. The charge middle distillates may have an initial boiling point (ibp) of at least about 300° F., and commonly about 320° F.–480° F. The ep may be 480° F.–680° F., say 465° F.–650° F.

These charge hydrocarbons may include naphtha (ibp of 70° F.–120° F.), kerosene (ibp of 300° F.–340° F.), light gas oil (ibp of 460° F.–480° F.), etc.

Many of these charge middle distillates may have an aromatics content as high as 80 v %, typically 20 v %–80 v %, say 25 v %–75 v %. In addition to the undesired aromatics content, they may contain other undesirables such as sulfur (0.1 w %–5 w %, typically 1 w %–4 w %) and nitrogen (10–1000 wppm, typically 0.001%–0.1 w %).

A typical charge which may be treated by the process of this invention may be a light straight run gas oil (LSRGO) having the following properties:

TABLE

| Property | Value |
|---|---|
| API Gravity | 35.9 |
| ibp °F. | 478 |
| 10% bp °F. | 503 |
| 50% bp °F. | 536 |
| 90% bp °F. | 592 |
| ep °F. | 648 |
| S w % | 1.40 |
| N ppm | 80 |
| Aromatics v % | 30 |

In practice of the process of this invention, the charge may be admitted to a catalyst bed at about 570° F.–850° F., preferably 570° F.–770° F., say about 716° F. and 500–3000 psig, preferably 600–2500 psig, say 1500 psig. Hydrogen is admitted at a flow rate of 1000–10,000 SCFB, preferably 2000–5000 SCFB, say about 4000 SCFB. LHSV based on catalyst volume may be 0.1–5, preferably 0.5–2, say about 1. LHSV (Liquid hourly space velocity is defined as: Volume of total Liquid Feed Run through the reactor per hour volume of Catalyst in Reactor.

The supported catalyst of this invention is prepared on an activated carbon support. Although it may be possible to utilize powdered carbon in a fludized bed, it is preferred to utilize extrudates in a packed bed. The support may be in the form of granules, pellets, or extrudates of carbon plus a refractory inorganic support. The surface area (Brunauer-Emmett-Teller-BET) of the carbon support is at least about 900 $m^2/g$. The Total Pore Volume (TPV) for nitrogen is at least about 0.4 cc/g, preferably 0.4–1.2 cc/g, say 0.8 cc/g. The Pore Diameter (average), by nitrogen physisorption is at least 16 Å, preferably 16 Å–50 Å, say 20 Å.

Illustrative commercially available carbon pellets, granules, or extrudates which may be used as catalyst supports used in fixed beds in practice of the process of this invention may include:

TABLE

A. The Norit RX carbon (of the Norit Company) acid-washed extrudate (3 mm diameter) having a surface area (BET) of 1424 $m^2/g$, a TPV of 0.8 cc/g (for nitrogen), Average Pore Diameter of 22.4 Å, an apparent bulk density of 410 g/l, and ash content of less than 4%.

B. The Norit R carbon (of the Norit Company) extrudate (3 mm diameter) having a surface area (BET) of 1217 $m^2/g$, a TPV of 0.67 cc/g (for nitrogen), Average Pore Diameter 22 Å, and an apparent bulk density of 410 g/l.

C. The Calgon WS-IV carbon (of the Calgon Company) extrudate (3.2 mm diameter) having a surface area (BET) of 1675 $m^2/g$, a TPV of 0.83 cc/g (for nitrogen), Average Pore Diameter 20 Å, apparent bulk density of 400 g/l, and ash content of less than 8%.

It is a particular feature of the process of this invention that the desired dearomatization of naphtha or middle distillate hydrocarbons is attained by use of a catalyst prepared from a carbon (whether as finely divided powder or as a granule) which is particularly characterized by a BET surface area of at least about 900 $m^2/g$, by a Total Pore Volume of at least about 0.4 cc/g, and by an average Pore Diameter of 16–50 Å which carbon has been loaded with 1–40 w % of VI-B metal and 0.1–15 w % of non-noble Group VIII metal.

The catalytic metals may be deposited on the carbon, either sequentially or simultaneously, by various processes including incipient wetness impregnation, equilibrium adsorption, etc. from aqueous or non-aqueous media.

The Group VI-B metal may preferably be molybdenum or tungsten,—present on the final catalyst in amount of 1–40 w %, preferably 8–35 w %, say 12 w % for Mo and preferably 28.8 w % for W.

The non-noble Group VIII metal may be cobalt or nickel, preferably nickel—present on the final catalyst in amount of 0.1–15 w %, preferably 3–12 w %, say 9.1 w %.

The Group VI-B metal may be loaded onto the catalyst support from a preferably aqueous solution of ammonium heptamolybdate or of ammonium metatungstate. The Group VIII non-noble metal may be loaded onto the catalyst support from a preferably aqueous solution of nickel nitrate hexahydrate.

It is preferred to deposit the Group VI-B metal first and thereafter the non-noble Group VIII metal with a drying step in between.

In a preferred embodiment, 100 parts of carbon support is contacted with an aqueous solution of a salt of the Group VI-B metal e.g. ammonium heptamolybdate in amount to fill the pores to incipient wetness. The support bearing the Group VI-B metals may be dried at 20°–150° C. say 115° C. for 16–24 hours, say 20 hours, optionally followed by calcination in air or inert atmosphere at 250°–450° C. say 300° C. for 2–6 hours, say 3 hours.

Thereafter the support bearing the Group VI-B metal is contacted with aqueous solution of the non-noble Group VIII metal e.g. nickel nitrate hexahydrate in amount to fill the pores to incipient wetness. The support bearing the Group VI-B and Group VIII metal is dried at 20°–150° C., say 115° C. for 16–24 hours, say 20 hours, optionally followed by calcination at 250° C.–450° C., say 300° C. for 2–6 hours, say 3 hours.

The catalyst so prepared contains 1–40 w %, preferably 8–35 w %, say 28.8 w % of Group VI-B metal (measured as metal) and 0.1–15 w %, say 9.1 w % of Group VIII metal (measured as metal). The metals may exist in the final catalyst composition as metals, metal oxides, oxide-precursors, or as partially decomposed compounds.

The catalyst, bearing both the, Group VI-B and non-noble Group VIII metals, is sulfided, preferably after loading into the fixed bed dearomatization reactor. Sulfiding may typically be effected by passing hydrogen sulfide, carbon disulfide, dimethyl sulfide, etc. through the bed (preferably in the presence of hydrogen) at 300° C.–450° C., say 350° C. (i e 570° F.–850° F., say 670° F.) and 0–1000 psig, say 0 psig for 2–24 hours, say 3 hours. Alternatively sulfiding may be carried out prior to loading the catalyst into the reactor. When the hydrocarbon to be treated by the process of this invention contains sulfur (typically in amount of about 1 w % or more) it may not be necessary to pre-sulfide the catalyst prior to use.

Practice of the process of this invention may be carried out by passing the charge middle distillate hydrocarbon into contact with the catalyst at 210° F.–840° F., say 716° F. and 500–3000 psig, say 1500 psig, at LHSV (based on catalyst) of 0.1–5, say 1, with hydrogen flow rates of 1000–10,000, say 4000 SCFB.

During hydrodearomatization, it is found that the aromatic content may be decreased from a charge content of 25–40 v %, say 30 v % down to a product content of 5–15 v %, say 10 v %. In the case for example of a light straight run gas oil (LSRGO) containing 30 w % aromatics, this content may be reduced to $<10$ w % in a typical operation.

Practice of the process of this invention will be apparent to those skilled in the art from the following wherein all parts are parts by weight unless otherwise stated. An asterisk (*) indicates a control example.

EXAMPLE I

In this Example, the activated carbon support is the carbon designated A in the Table supra. This activated carbon is crushed and sieved; and the fraction which passes through 20-mesh and is retained on 40-mesh is used without further treatment to prepare the catalyst.

9.2 parts of ammonium heptamolybdate. 4 $H_2O$ (AHM) is dissolved in 19 parts of fresh deionized water. Carbon A (30 parts) is impregnated with this solution to incipient wetness. The mixture is left to stand at room temperature with occasional stirring for 2 hours and then heated slowly at a rate of 0.3° C./min to 110° C. in an oven with a nitrogen blanket. The material is maintained at that temperature for 18 hours then cooled to room temperature over 3 hours.

The product so formed is impregnated to incipient wetness with a solution of 15.2 parts of nickel (II) nitrate hexahydrate in 14 parts of deionized water. After standing at room temperature (with occasional stirring) for 2 hours, the product is heated slowly at a rate of 0.3° C./min to 110° C. in an oven with a nitrogen blanket. The material is maintained at that temperature for 18 hours and then cooled to room temperature over 3 hours.

The molybdenum exists in the catalyst most probably as partially decomposed ammonium molybdate; and the nickel most probably as partially decomposed nickel nitrate. If all the ammonium molybdate and nickel nitrate would have decomposed to oxides, the final catalyst would contain 18.15 w % $MoO_3$ (12.1 w % Mo) and 9.4 w % NiO (7.4 w % Ni), the balance being carbon.

EXAMPLE II

In this Example, the activated carbon support is the carbon designated A in the Table supra. This activated carbon is crushed and sieved; and the fraction which passes through 20-mesh and is retained on 40-mesh is used without further treatment to prepare the catalyst.

25.8 parts of ammonium heptamolybdate. 4 $H_2O$ (AHM) is dissolved in 49 parts of fresh deionized water. Carbon A (68 parts) is impregnated with this solution to incipient wetness. The mixture is left to stand at room temperature with occasional stirring for 2 hours and then heated slowly at a rate of 0.3° C./min to 115° C. in an air. The material is maintained at that temperature for 24 hours then cooled to room temperature over 3 hours.

The product so formed is impregnated to incipient wetness with a solution of 44.8 parts of nickel (II) nitrate hexahydrate in 23 parts of deionized water. After standing at room temperature (with occasional stirring) for 2 hours, the product is heated slowly at a rate of 0.3° C./min to 110° C. in an air oven. The material is maintained at that temperature for 18 hours and then cooled to room temperature over 3 hours.

The molybdenum exists in the catalyst most probably as partially decomposed ammonium molybdate; and the nickel most probably as partially decomposed nickel nitrate. If all the ammonium molybdate and nickel nitrate would have decomposed to oxides, the final catalyst would contain 21 w % $MoO_3$ (14 w %Mo) and 11.4 w % NiO (9 w % Ni), the balance being carbon.

EXAMPLE III

In this Example, the activated carbon support is the carbon designated B in the Table supra. This activated carbon is crushed and sieved; and the fraction which passes through 20-mesh and is retained on 40-mesh is used without further treatment to prepare the catalyst.

11.8 parts of ammonium heptamolybdate. 4 $H_2O$ (AHM) is dissolved in 29 parts of fresh deionized water. Carbon B (50 parts) is impregnated with this solution to incipient wetness. The mixture is left to stand at room temperature with occasional stirring for 2 hours and then heated slowly at a rate of 0.3° C./min to 110° C. in an air oven.

The material is maintained at that temperature for 18 hours then cooled to room temperature over 3 hours.

The product so formed is impregnated to incipient wetness with a solution of 15.8 parts of nickel (II) nitrate hexahydrate in 22 parts of deionized water. After standing at room temperature (with occasional stirring) for 2 hours, the product is heated slowly at a rate of 0.3° C./min to 110° C. in an air oven. The material is maintained at that temperature for 18 hours and then cooled to room temperature over 3 hours.

The molybdenum exists in the catalyst most probably as partially decomposed ammonium molybdate; and the nickel as partially decomposed nickel nitrate. If all the ammonium molybdate and nickel nitrate would have decomposed to oxides, the final catalyst would contain 15 w % $MoO_3$ (10 w % Mo) and 6.35 w % NiO (5 w % Ni), the balance being carbon.

EXAMPLE IV

In this Example the activated carbon support is the carbon designated A in the Table supra. This activated carbon is crushed and sieved; and the fraction which passes through 20-mesh and is retained on 40-mesh is used without further treatment to prepare the catalyst.

20.2 parts of ammonium metatungstate $(NH_4)_6H_2W_{12}O_{40}$ (AMT) is dissolved in 20.5 parts of fresh deionized water. Carbon A (27.5 parts) is impregnated with this solution to incipient wetness. The mixture is left to stand at room temperature with occasional stirring for 2 hours and then heated slowly at a rate of 0.3° C./min to 110° C. in an air oven. The material is maintained at that temperature for 18 hours then cooled to room temperature over 3 hours.

The product so formed is impregnated to incipient wetness with a solution of 23.7 parts of nickel (II) nitrate hexahydrate in 10 parts of deionized water. After standing at room temperature (with occasional stirring) for 2 hours, the product is heated slowly at a rate of 0.3° C./min to 110° C. in an air oven. The material is maintained at that temperature for 18 hours and then cooled to room temperature over 3 hours.

The molybdenum exists in the catalyst most probably as partially decomposed ammonium molybdate; and the nickel most probably as partially decomposed nickel nitrate. If all the ammonium metatungstate and nickel nitrate would have decomposed to oxides, the final catalyst would contain 36.3 w % $WO_3$ (28.8 w % W) and 11.6 w % NiO (9.1 w % Ni), the balance being carbon.

EXAMPLE V*

In this control Example, the support is United Catalysts Inc 331-1alumina which is ground to 20–40 mesh and calcined in air flow at 500° C. for 3 hours to yield a product having a BET surface area of 260 $m^2/g$, a pore volume (by mercury porosimetry) of 0.73 cc/g, and a pore volume (by water absorption) of 0.83 cc/g.

11.1 parts of ammonium heptamolybdate. 4 $H_2O$ (AHM) is dissolved in 29 parts of fresh deionized water. The alumina (37.5 parts) is impregnated with this solution to incipient wetness. The mixture is left to stand at room temperature with occasional stirring for 2 hours and then heated slowly at a rate of 0.3° C./min to 115° C. in an air oven. The material is maintained at that temperature for 24 hours then cooled to room temperature over 3 hours. It is then heated in air flow (1000 ml/min) to 500° C. over 3 hours maintained at that temperature for 3 hours, and cooled to room temperature in about 4 hours in air flow.

The product so formed is impregnated to incipient wetness with a solution of 7.3 parts of nickel (II) nitrate hexahydrate in 24 parts of deionized water. After standing at room temperature (with occasional stirring) for 2 hours, the product is heated slowly at a rate of 0.3° C./min to 115° C. in an air oven. The material is maintained at that temperature for 24 hours and then cooled to room temperature over 3 hours. It is then heated in flowing air to 500° C. over 3 hours, maintained at that temperature for 3 hours, and cooled to room temperature over 4 hours in air flow.

The final catalyst contains 18.6 w % $MoO_3$ (12.4 w % Mo) and 3.8 w % NiO (3.0 w % Ni), the balance being alumina.

EXAMPLE VI*

In this control Example, the procedure of Example V* is duplicated except that the quantity of nickel is 12.2 parts. The product contains 18.5 w % $MoO_3$ (12.3 w %Mo) and 6 3 w % NiO (5 w % Ni), balance alumina.

EXAMPLE VII*

In this control Example, the procedure of Example V, is duplicated except that cobalt (II) nitrate (7.3 parts) is used instead of nickel nitrate. The product contains 18.6 w % $MoO_3$ (12.4 w % Mo) and 3 w % Co existing as cobalt oxide, balance alumina.

EXAMPLE VIII–XIV*

In this series of Examples, the catalysts of Examples I–VII are evaluated for their ability to effect hydrodearomatization (HDA), hydrodesulfurization (HDS), and hydrodenitrification (HDN) in a standard fixed bed hydrotreating reactor. In each Example, 10 volumes of catalyst (except for Example 3 wherein 15 volumes of catalyst are employed) are loaded into the hydrotreating reactor; and, after oxygen is purged (with helium), 100 volumes/minute of a sulfiding gas (10 v % hydrogen sulfide in hydrogen) is passed over the catalyst for 15 minutes at room temperature and 1 atmosphere pressure.

With the sulfiding gas flowing, the temperature of the reaction vessel is increased at 3° C./min to 350° C. at which temperature it is then maintained for 2 more hours. The temperature is then changed to the reaction temperature. Back pressure (100 psig) is then applied to the reactor; and the liquid feed flow is started at the desired LHSV. Once liquid passes beyond the catalyst bed, the flow of sulfiding gas is cut off, the flow of hydrogen is started at the desired rate, and the reactor pressure is increased to the desired pressure. At this time, it is considered that actual hydrotreating starts.

During the reaction, aromatic components of the charge are dearomatized and the contents of nitrogen and sulfur are also decreased.

After about 20 hours on stream, the liquid products are collected and sparged with hydrogen to remove dissolved hydrogen sulfide and ammonia. Analyses are then conducted for sulfur, nitrogen, and aromatics.

The charge liquid to these catalysts is a light straight run gas oil (LSRGO) having the following properties:

TABLE

| Property | Value |
|---|---|
| API Gravity | 35.9 |
| ibp °F. | 478 |
| 10% | 503 |
| 50% | 536 |
| 90% | 592 |
| ep | 648 |
| S w % | 1.40 |
| N ppm | 80 |
| Aromatics v % | 30 |

Sulfur content is determined by X-ray fluorescence (XRF) by ASTM Test D-2622.

Nitrogen content is determined by chemiluminessence by ASTM Test #ST 447.

Aromatics content is determined by Open Column Liquid Chromatography (OCLC) ASTM D-2549.

It should be noted that in all these comparative Examples, the reaction conditions employed (380° C. or 716° F., 1000 psig, LHSV of 1.0, hydrogen 3200 SCFB) are chosen so that only partial hydrodearomatization occurs. This permits one to compare the activities of the different catalysts under identical reaction conditions.

The following Table summarize the results on an equal volume basis.

TABLE

| Example | Catalyst | % VIB | % VIII | % HDS | % HDN | % HDA |
|---|---|---|---|---|---|---|
| VIII | I | 12.1 | 7.4 | 99.9 | 98.6 | 55 |
| IX | II | 14.0 | 9.0 | 99.9 | 100 | 47 |
| X | III | 10.0 | 5.0 | 99.9 | 98.7 | 48 |
| XI | IV | 28.8 | 9.1 | 99.9 | 98.7 | 59 |
| XII* | V* | 12.4 | 3.0 | 99.7 | 98.8 | 40 |
| XIII* | VI* | 12.3 | 5.0 | 99.8 | 98.7 | 37 |
| XIV* | VII* | 12.4 | 3.0 | 99.7 | 98.8 | 38 |

From the above Table, the following conclusions may be drawn:

(i) Experimental Examples VIII–XI show hydrodearomization activity which is substantially better (by as much as 59/37 or 160%) than is attained by control Examples XII*–XIV*.

(ii) Experimental Examples VIII–XI also show almost complete removal of sulfur and nitrogen from the charge hydrocarbon.

(iii) It is to be noted that the data tabulated in the above Table are on an EQUAL VOLUME basis. The activated carbon support employed in practice of this invention typically has a significantly lower density (0.41 g/cc) than does the alumina support (0.51 g/cc). Accordingly on an equal weight basis the carbon supported catalysts of this invention are immensely more active for hydrodearomatization of the noted charge than are the alumina-based catalysts.

EXAMPLE XV

In this example which represents the best mode presently known of carrying out the process of this invention, the charge is a light atmospheric gas oil having the following characteristics:

| Property | Value |
|---|---|
| ibp °F. | 258 |
| 20% | 518 |
| 40% | 566 |
| 60% | 614 |
| 80% | 665 |
| 90% | 699 |
| 95% | 721 |
| EBP | 765 |
| Sulfur w % | 0.70 |
| Nitrogen w % | 0.048 |
| wppm | 480 |
| Aromatics v % (OCLC) | 35 |
| Aromatics w % (SFC) | 32 |

The catalyst employed is the 20–40 mesh nickel-tungsten catalyst as prepared in Example IV.

Reaction is carried out at 380° C. (716° F.) 1500 psig total pressure, LHSV of 1.0, and hydrogen flow rate of 4000 SCFB.

The weight percentage of aromatics converted to non-aromatics, measured by the OCLC method of analysis, is 64 w % and, measured by the SFC method is 70 w %. The (SFC) aromatics content of the product is 9.6 w % The percent of hydrodesulfurization of the charge oil is 99.9w %. The percent of hydrodenitrification of the charge oil is 99.8 w %.

Although this invention has been illustrated by reference to specific embodiments, it will be apparent to those skilled in the art that various charges and modifications may be made which clearly fall within the scope of the invention.

What is claimed:

1. The method of treating a charge naphtha or middle distillate hydrocarbon oil containing undesired aromatic components, sulfur and nitrogen compounds which comprises:

maintaining a bed of sulfided catalyst containing a metal of non-noble Group VIII and a metal of Group VIB on a carbon support;

passing a charge naphtha or middle distillate hydrocarbon containing 0.5 to 5 wt % sulfur and 0.001 to 0.1 wt % nitrogen in the presence of hydrogen into contact with said sulfided catalyst containing a metal of Group VIII and of Group VIB on a carbon support at 570° F.–850° F. and 600 psig to 2500 psi and a hydrogen flow of 1000–5000, SCFB (Standard cubic feet per barrel of liquid feed), thereby effecting hydrodearomatization, hydrodesulfurization and hydrodenitrogenation of said charge hydrocarbon containing undesired aromatic components, sulfur and nitrogen and forming a product stream of hydrocarbon essentially having the same boiling range as the charge hydrocarbon oil and containing a lesser quantity of undesired aromatic components, sulfur and nitrogen, said catalyst support consisting essentially of activated carbon having a BET (Brunauer-Emmett Teller) surface area of at least about 900 $m^2/g$, an average Pore Diameter between 16 Å and 50 Å, and a Total Pore Volume (for nitrogen) of 0.4 to 1.2 cc/g; and recovering said product stream of hydrocarbon containing a lesser quantity of undesired aromatic components, sulfur and nitrogen.

2. The method of treating a charge naphtha or middle distillate hydrocarbon containing undesired aromatic components as claimed in claim 1 wherein said charge middle distillate hydrocarbon is a middle distillate having an initial boiling point of about of 320° F.–480° F.

3. The method of treating a charge naphtha or middle distillate hydrocarbon containing undesired aromatic components as claimed in claim 1 wherein said charge middle distillate hydrocarbon is a gas oil.

4. The method of treating a charge naphtha or middle distillate hydrocarbon containing undesired aromatic components as claimed in claim 1 wherein said charge middle distillate hydrocarbon is a diesel fuel.

5. The method of treating a charge naphtha or middle distillate hydrocarbon containing undesired aromatic components as claimed in claim 1 wherein said charge middle distillate hydrocarbon is a kerosene.

6. The method of treating a charge naphtha or middle distillate hydrocarbon containing undesired aromatic components as claimed in claim 1 wherein said non-noble Group VIII metal is nickel.

7. The method of treating a charge naphtha or middle distillate hydrocarbon containing undesired aromatic components as claimed in claim 1 wherein said Group VI-B metal is tungsten.

8. The method of treating a charge naphtha or middle distillate hydrocarbon containing undesired aromatic components as claimed in claim 1 wherein said carbon support is a carbon extrudate.

9. The method of treating a charge naphtha or middle distillate hydrocarbon containing undesired aromatic components as claimed in claim 1 wherein said carbon support is a pelletized carbon containing a refractory inorganic matrix.

10. The method of treating a charge naphtha or middle distillate hydrocarbon oil containing undesired aromatic components which comprises:

maintaining a bed of sulfided catalyst containing a metal of Group VIII selected from cobalt and nickel and a metal of Group VIB selected from molybdenum and tungsten on a carbon support;

passing a charge naphtha or middle distillate hydrocarbon containing 0.5 to 5 wt % sulfur and 0.001 to 0.1 wt % nitrogen in the presence of hydrogen into contact with said sulfided catalyst containing a metal of Group VIII and of Group VIB on a carbon support at 570° F.–850° F. and 600 psig to 2500 psig and a hydrogen flow rate of 1000–5000 SCFB, thereby effecting hydrodearomatization of said charge hydrocarbon containing undesired aromatic components and forming a product stream of hydrocarbon essentially having the same boiling range as the charge hydrocarbon oil and containing a lesser quantity of undesired aromatic components, said catalyst support consisting essentially of activated carbon having a BET Brunauer-Emmett Teller) surface area of at least about 900 $m^2/g$, an average Pore Diameter between 16 Å and 50 Å, and a Total Pore Volume (for nitrogen) of 0.4 to 1.2 cc/g; and recovering said product stream of hydrocarbon containing a lesser quantity of undesired aromatic components.

* * * * *

UNITED STATES PATENT AND TRADEMARK OFFICE

CERTIFICATE OF CORRECTION

PATENT NO. : 5,435,907

DATED : July 25, 1995

INVENTOR(S) : Chakka (NMN) Sudhakar, Frank (NMN) Dolfinger, Jr., Dennis Joseph Rao and John (NMN) Hazen It is certified that error appears in the above-identified patent and that said Letters Patent is hereby corrected as shown below:

Title page, Line 7, delete "Dennis J. Pao" and insert therefor -- Dennis J. Rao --.

Signed and Sealed this

Twenty-fourth Day of October, 1995

*Attest:*

Bruce Lehman

BRUCE LEHMAN

*Attesting Officer*

*Commissioner of Patents and Trademarks*